US005801493A

United States Patent [19]

Antonis et al.

[11] Patent Number: 5,801,493

[45] Date of Patent: Sep. 1, 1998

[54] ELECTRODELESS LOW PRESSURE DISCHARGE LAMP WITH IMPROVED HEAT TRANSFER FOR SOFT MAGNETIC CORE MATERIAL

[75] Inventors: Petrus H. Antonis; Gibbo J. Abrahamse; Hendrik J. Eggink; Marcellus H. Smulders, all of Eindhoven, Netherlands

[73] Assignee: U.S. Philips Corporation, New York, N.Y.

[21] Appl. No.: 767,598

[22] Filed: Dec. 9, 1996

[51] Int. Cl.[6] ..... H05B 41/16

[52] U.S. Cl. ..... 315/248; 315/344; 313/46; 313/488; 313/493

[58] Field of Search ..... 315/248, 62, 285, 315/344; 313/46, 161, 485–488, 493; 362/263

[56] References Cited

U.S. PATENT DOCUMENTS

| | | | |
|---|---|---|---|
| 3,987,335 | 10/1976 | Anderson | 315/62 |
| 4,065,701 | 12/1977 | Haugsjaa et al. | 315/248 |
| 4,536,675 | 8/1985 | Postma | 313/46 |
| 4,622,495 | 11/1986 | Smeelen | 315/248 |
| 4,661,746 | 4/1987 | Postma et al. | 315/248 |
| 5,006,752 | 4/1991 | Eggink et al. | 313/161 |
| 5,130,912 | 7/1992 | Friederichs et al. | 315/248 X |
| 5,572,083 | 11/1996 | Antonis et al. | 313/46 |
| 5,598,069 | 1/1997 | Van Os et al. | 315/248 |
| 5,621,266 | 4/1997 | Popov et al. | 313/46 |
| 5,696,426 | 12/1997 | Antonis et al. | 315/248 X |

*Primary Examiner*—Robert J. Pascal
*Assistant Examiner*—Haissa Philogene
*Attorney, Agent, or Firm*—F. Brice Faller

[57] ABSTRACT

A discharge vessel (10) closed in a gastight manner has a cavity (11) enclosing a discharge space provided with an ionizable filling. A coil (20) with a winding (21) of an electric conductor and an assembly (30) of a heat conductor (31) and one or several elongate cores (32) of soft-magnetic material are accommodated in the cavity. The cores (32) are arranged along a longitudinal axis (33) of the heat conductor (31) in one or several recesses (34) of the heat conductor which issue into a circumferential surface (36) of the assembly (30). The heat conductor (31) occupies at least half the circumference in a cross-section perpendicular to the longitudinal axis (33) of the assembly (30). The construction of the lamp according to the invention renders possible lamp operation at higher lamp powers also without the use of a heat pipe.

11 Claims, 2 Drawing Sheets

ELECTRODELESS LOW PRESSURE DISCHARGE LAMP WITH IMPROVED HEAT TRANSFER FOR SOFT MAGNETIC CORE MATERIAL

BACKGROUND OF THE INVENTION

The invention relates to an electrodeless low-pressure discharge lamp provided with a discharge vessel which is closed in a gastight manner, which has a cavity, which encloses a discharge space, and which is provided with an ionizable filling. A coil with a winding of an electric conductor and an assembly of a heat conductor with one or several elongate cores of soft-magnetic material are accommodated in the cavity, which cores are arranged along a longitudinal axis of the assembly in one or several recesses of the heat conductor which issue into a circumferential surface of the assembly.

An electrodeless low-pressure discharge lamp is known from U.S. Pat. No. 3,987,335, provided with an annular core of soft-magnetic material in a metal sheath. The sheath has mutually overlapping edges along the inner circumference of the core, which edges are fastened to one another with glass so as to insulate them electrically from one another and safeguard a gastight closure of the discharge vessel. The core with its sheath is partly accommodated in the discharge space and partly extends outside this space. A metal strip for removing heat absorbed by the sheath is fastened to the sheath. Such a lamp is difficult to manufacture. On the one hand it is difficult to form a sheath around an annular core from a single piece of metal. On the other hand, the presence of the mutually overlapping edges along the inner circumference of the core renders the manufacture of a gastight closure difficult.

A lamp of the kind described in the opening paragraph is much easier to assemble when the coil by means of which the lamp is operated and the accompanying assembly are positioned entirely outside the discharge space. Such a lamp is known from U.S. Pat. No. 4,536,675. In the known lamp, the discharge vessel has a filling of mercury and argon, and an inner surface of the discharge vessel is provided with a luminescent layer. The coil arranged in a cavity of the discharge vessel surrounds a circumferential surface of an assembly of a copper heat conductor with four rod-type cores of soft-magnetic material. The cores are arranged in recesses bounded by four ribs of the heat conductor and issuing into the circumferential surface of the assembly. The heat conductor is to counteract an excessively high temperature of the cores of soft-magnetic material. This is because the magnetic permeability of the soft-magnetic material falls sharply at a too high temperature. This is disadvantageous for the luminous efficacy of the lamp. The lamp may even extinguish then. The known lamp is suitable for operation at a power of 15 W, which is comparatively low. It is stated in the Patent document that the effect of a heat conductor outside the core is small in the case of cores having a shape other than the annular shape, as shown in U.S. Pat. No. 3,987,335, owing to eddy currents occurring in the heat conductor.

U.S. Pat. No. 5,006,752 discloses an electrodeless low-pressure discharge lamp in which a heat pipe is used, accommodated in the core of the assembly, instead of a solid heat conductor. This heat pipe is a closed tube in which heat transport takes place through a medium capable of evaporation. The medium absorbs heat upon evaporation at an end portion inside the core. When condensing at an opposed end portion of the heat pipe, the medium releases the absorbed heat and flows back through capillary channels in the heat pipe to the end portions situated in the core. This construction renders lamp operation at higher powers possible. The lamp known from the Patent document is operated at a power of approximately 90 W. It is a disadvantage, however, that the heat pipe is a comparatively expensive component.

OBJECTS AND SUMMARY OF THE INVENTION

It is an object of the invention to provide a lamp of the kind described in the opening paragraph which is suitable for operation at higher powers and in which the use of a heat pipe is unnecessary.

To achieve this object, the heat conductor occupies at least half the circumference of the assembly in a cross-section perpendicular to the longitudinal axis. If the heat conductor accounts for less than half the circumference of the assembly, the heat transfer is insufficient because the thermal contact between the heat conductor and the cavity of the discharge vessel is insufficient for an efficient heat transfer between these components. In a practical embodiment, the fraction of the circumference of the assembly occupied by the heat conductor lies, for example, in a range from 0.60 to 0.95.

In the lamp according to the invention, the one or several cores of soft-magnetic material have an elongate shape, and the heat conductor extends in radial direction outside said one or several cores to a considerable extent. The inventors have found that heat generation in the heat conductor owing to eddy current losses is sufficiently small for facilitating an efficient lamp operation and a satisfactory operation of the heat conductor, provided the recesses in the heat conductor issue into the circumferential surface. The lamp according to the invention is particularly suitable for operation at comparatively high lamp powers, for example, powers from 100 to 200 W.

In contrast to the lamps known from U.S. Pat. No. 4,536,675 and U.S. Pat. No. 5,006,752, where the heat transport from the cavity to the heat conductor takes place to a major degree through the one or several cores of soft-magnetic material, said one or several cores of soft-magnetic material hardly play a part in the heat transport in the lamp according to the invention. The inventors further found that the heat generation in the cores themselves is negligible compared with the heat generation in the discharge vessel. The cores of soft-magnetic material may therefore be accommodated in the recesses in the heat conductor with a wide tolerance. This is favorable in the manufacture of the cores and the heat conductor as well as during the assembly of said components.

In a favorable embodiment of the lamp according to the invention, the heat conductor accounts for at least one fourth, for example one third up to two thirds, of the total surface area of the assembly of the heat conductor and the one or several cores of soft-magnetic material in the cross-section perpendicular to the longitudinal axis. This provides for a great freedom of design, in particular as to the choice of material for the heat conductor.

Suitable materials for the heat conductor are, for example, copper and aluminum. Alloys such as brass, for example $CuZn_{15}$, are also suitable. Copper has the advantage of a high thermal conductivity. Aluminum is light and inexpensive and in addition easy to machine. The material of the heat conductor may comprise additives, for example silicon, for improving its machining qualities.

The winding of the coil may be accommodated in a recess of the heat conductor together with a core of soft-magnetic material surrounded by it. This has the advantage that the winding cannot adversely affect the heat transport from the cavity to the heat conductor. It may be necessary to provide additional means, such as an auxiliary electrode, for igniting the lamp. An embodiment which is easier to assemble is one in which the winding completely surrounds the assembly of the heat conductor and the one of several cores of soft-magnetic material.

Several cores of soft-magnetic material may be accommodated in a single recess of the heat conductor. The recess may, for example, issue into the circumferential surface of the assembly adjacent each core, but may alternatively issue into a joint opening for the cores.

The heat conductor may have a portion which extends beyond the cores of soft-magnetic material. This portion may end, for example, in a flange for facilitating a better heat transport to a heat sink. In that case, a first portion of the heat conductor forming an assembly with the cores of soft-magnetic material, a second portion extending beyond that, and the flange may be separate components. The first portion may have, for example, a cross-section which is constant over its length, for example manufactured in an extrusion process, while the second portion and the flange are manufactured, for example, in a die-casting process. Preferably, however, said portions and the flange are integral. This is favorable for the heat transport and simplifies lamp assembly.

A favorable embodiment of the electrodeless low-pressure discharge lamp according to the invention is characterized in that the assembly comprises at least two cores of soft-magnetic material which are arranged in the heat conductor around the longitudinal axis of the assembly. The lamp has a comparatively high luminous efficacy in this embodiment. In addition, this construction contributes to a reduction of the electromagnetic interference caused by the lamp.

In an attractive embodiment of the lamp according to the invention, the heat conductor has a recess with a laterally clearing shape on either side of the longitudinal axis. A heat conductor having this shape can be easily manufactured in a die-casting process.

The lamp according to the invention may be provided with an exhaust tube. A preferred embodiment of the lamp according to the invention is one in which the cavity of the discharge vessel is provided with an exhaust tube which extends centrally within the assembly. The exhaust tube is better protected against damage here than in an embodiment in which the exhaust tube is fastened to a portion of the discharge vessel which surrounds the cavity.

An advantageous embodiment of the electrodeless low-pressure discharge lamp according to the invention is characterized in that the cavity is provided with a UV-reflecting layer. This layer prevents ultraviolet radiation from being absorbed by the cavity or components arranged therein, so that the thermal load on the cavity and these components is further reduced. A luminescent layer may be provided on the former layer.

BRIEF DESCRIPTION OF THE DRAWINGS

These and other aspects of the invention will be explained in more detail with reference to the drawing, in which.

DESCRIPTION OF THE PREFERRED EMBODIMENT

Figure 1:
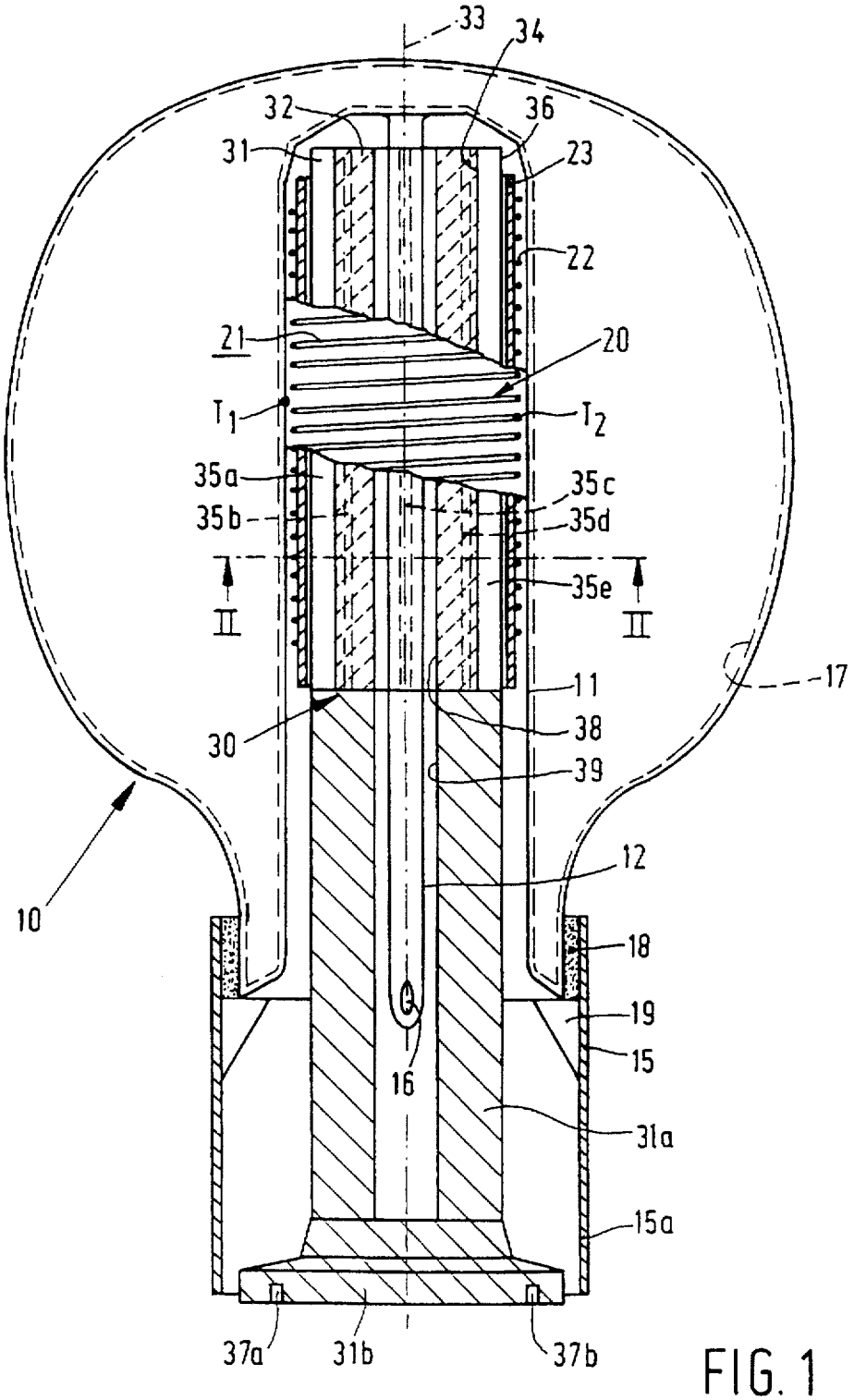
FIG. 1 is a longitudinal view of the lamp according to the invention, partly in cross-section, partly in elevation.

The electrodeless low-pressure discharge lamp shown in FIG. 1 is provided with a discharge vessel 10 which is closed in a gastight manner, which has a cavity 11 and a discharge space, and which is provided with an ionizable filling. The discharge vessel 10 is fastened by means of cement 18 to a holder 15 of synthetic resin and can rest on seats 19 in the holder. The lamp here contains an amalgam 16 of mercury with an alloy of bismuth and indium so as to maintain a mercury vapor pressure of approximately 0.5 Pa in the discharge vessel during nominal operation, while the discharge vessel 10 in addition has a filling of neon and argon (90/10% by volume) with a filling pressure of 33 Pa. The discharge vessel 10 supports a luminescent layer 17 on its inner surface. A coil 20 with a winding 21 of an electric conductor is accommodated in the cavity 11. In the embodiment shown, the winding 21 has twenty-one turns 22 evenly distributed over a length of 80 mm around a synthetic-resin coil former 23. Suitable synthetic resins for this are, for example, polyphenylene sulphide and polyether etherketone. The synthetic resin of the coil former may be reinforced with glass fibers. The coil 20 surrounds an assembly 30 of a copper heat conductor 31 and of one or several cores 32, here one cylindrical core, of soft-magnetic material (shown in cross-section in FIG. 2). The cylindrical core 32 is made here from a NiZn-ferrite with a magnetic permeability value of 150. The cylindrical core 32, which has a diameter of 22 mm and a length of 80 mm, is arranged along a longitudinal axis 33 of the assembly 30 in a recess 34 of the heat conductor 31, which is also cylindrical. The heat conductor 31 has a diameter of 28 mm. The recess 34 of the heat conductor issues into the circumferential surface 36 of the assembly 30 via eight slits 35*a* . . . *h* of 1 mm width evenly distributed over the circumference. Slits 35*b* . . . *d* are shown in FIG. I with broken lines. The heat conductor 31 extends with an end portion 31*a* to beyond the cylindrical core 32 of soft-magnetic material up to an end 15*a* of the synthetic-resin holder 15, where it is provided with a flange 31*b* with threaded holes 37*a*, 37*b* for fastening the heat conductor 32 to a heat sink (not shown). The cylindrical core 32 has a cavity 38 of 9 mm diameter. In the extended direction thereof, the heat conductor 31 has a cavity 39 of equal diameter.

Figure 2:
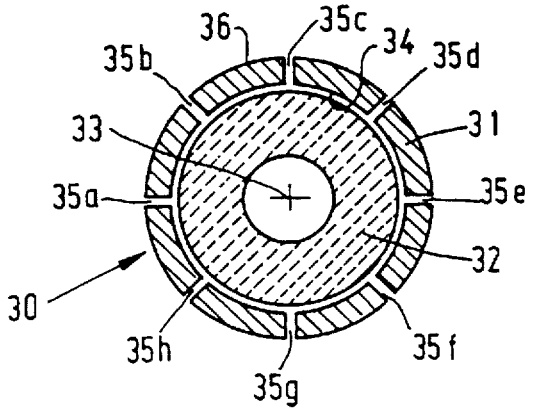
FIG. 2 is a cross-section of the assembly of the lamp taken on the line II—II in FIG. 1, FIGS. 3 and 4 are cross-sections of the assemblies of a second and a third embodiment, respectively.

The assembly 30 has a circumference of 88 mm in a cross-section II—II perpendicular to the longitudinal axis 33 (see FIG. 2). The heat conductor 80 accounts for 80 mm thereof, i.e. more than half, here a fraction 0.91 of the circumference. The heat conductor 31 and the core 32 of soft-magnetic material have surface areas of 212 $mm^2$ and 317 $mm^2$, respectively, in the cross-section II—II. The heat conductor 31 accordingly accounts for at least one fourth, here a fraction 0.40, of the total surface area of the assembly 30 of the heat conductor 31 and the one or several cores 32 of soft-magnetic material.

In the embodiment of the lamp according to the invention shown in FIGS. 1 and 2, the discharge vessel 10 is provided with an exhaust tube 12 at its cavity 11, which tube extends centrally within the assembly 30 through the cavity 38 in the core 32 of soft-magnetic material into the cavity 39 of the end portion 31*a* of the heat conductor 31.

In a modification of the embodiment shown, the cavity 11 may have, for example, a UV-reflecting layer underneath or instead of the luminescent layer 17.

The lamps described below with reference to FIGS. 3 to 5 differ from the lamp of FIGS. 1 and 2 exclusively in the assemblies used therein.

Figure 3:
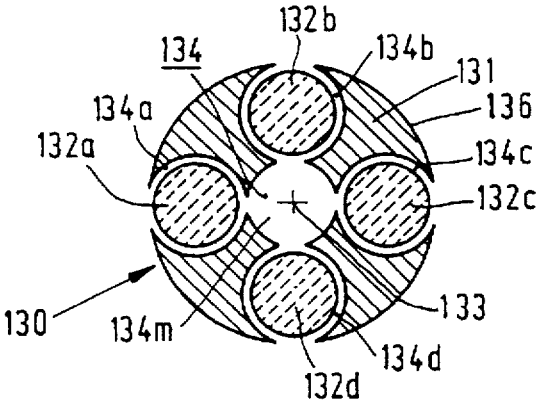

The assembly of a second embodiment of the lamp according to the invention is shown in cross-section in FIG. 3. Components therein corresponding to those of FIG. 2 have reference numerals which are 100 higher. The assembly 130 shown comprises a cylindrical heat conductor 131 with a diameter of 28 mm. At least two, in this case four cylindrical cores 132*a* . . . *d* of soft-magnetic material with a diameter of 9 mm are arranged around the longitudinal axis 133 in peripheral compartments 134*a* . . . *d* of a recess 134 in the heat conductor 131. The recess 134 in the heat conductor 131 further has a central compartment 134*m* for accommodating an exhaust tube connected to the cavity of the discharge vessel. The peripheral compartments 134*a* . . . *d* each issue into the circumferential surface 136 of the heat conductor 131 and together account for a fraction 0.20 of the circumference of the assembly 130 in the cross-section shown, which means that the heat conductor 131 occupies more than half the circumference. The heat conductor 131 accounts for more than one fourth, here a fraction 0.48, of the total surface area of the heat conductor 131 and the four cores 132*a* . . . *d* of soft-magnetic material in the cross-section shown.

Figure 4:
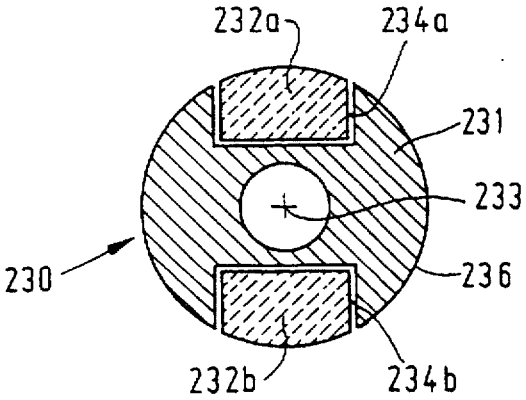

In FIG. 4, components corresponding to those of FIG. 2 have reference numerals which are 200 higher. The heat conductor 231 of the assembly 230 shown therein has a recess 234*a*, 234*b* of a laterally clearing shape on either side of the longitudinal axis 233. The cores 232*a*, 232*b* of soft-magnetic material arranged in the recesses 234*a*, 234*b* are of substantially rectangular cross-section. The heat conductor 231 occupies more than half, here a fraction 0.68, of the circumference of the assembly 230 in the cross-section shown. The heat conductor 231 accounts for 0.60, i.e. more than one fourth, of the total surface area.

Figure 5:
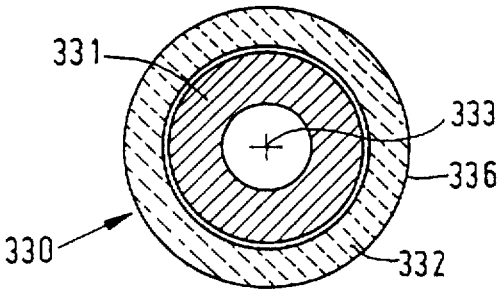
FIG. 5 PRIOR ART
FIG. 5 is a cross-section of an assembly of a lamp not according to the invention.

FIG. 5 shows a cross-section of an assembly of a lamp not according to the invention for the purpose of comparison. Components therein corresponding to those of FIG. 2 have reference numerals which are 300 higher. The assembly 330 has a heat conductor 331 of 9 mm internal diameter and 19.8 mm external diameter which is surrounded by a tubular core 332 of soft-magnetic material with an internal diameter of 20 mm and an external diameter of 28 mm. The heat conductor 331 occupies a fraction 0.45 of the surface area of the cross-section perpendicular to the longitudinal axis 333. The heat conductor 331, however, does not form part of the circumferential surface 336 of the assembly 330.

In the ensuing description, the lamps of FIGS. 2, 3 and 5 are indicated with inv1, inv2, and ref, respectively.

The inventors have found during experiments that the temperature T1 in the center of the cavity and the temperature T2 of the coil winding opposite this location assume high values during operation. It is necessary for obtaining a long lamp life that T1 and T2 are below 300° and 260° C., respectively. The following values were measured for the temperatures T1 and T2 of the lamps "inv1", "inv2" and "ref" during stationary operation at a power of 180 W.

| | inv1 | inv2 | ref |
|---|---|---|---|
| T1 (°C.) | 283 | 286 | 297 |
| T2 (°C.) | 239 | 247 | 263 |

The temperature T2 of the winding remained well below the requirement of 260° C. in lamps according to the invention. This limit was exceeded, however, in the lamp "ref" not according to the invention. In addition, the upper limit of 300° C. for the temperature T1 of the cavity wall was approached closely in this lamp.

Luminous efficacies of 73.9, 75.9, and 77.1 lm/W were measured for the lamps "inv1", "inv2", and "ref", respectively. The luminous efficacies of the lamps "inv1" and "inv2" accordingly were no more than 4.2% and 1.5%, respectively, lower than the luminous efficacy of the lamp "ref". This demonstrates that the proportion of eddy current losses in the total power dissipation of the lamp remains sufficiently low for facilitating an efficient lamp operation. The magnetic interference level caused by the lamps of FIG. 3 ("inv2") and FIG. 4 was found to be approximately 0.5 dB lower than that caused by the lamps of FIG. 2 ("inv1") and FIG. 5 ("ref").

Further experiments showed that a small clearance between the soft-magnetic material and an internal heat conductor already led to a strongly reduced loading capacity of the lamp "ref" not according to the invention. Clearance between the heat conductor and the soft-magnetic material in lamps according to the invention, on the other hand, was found to have scarcely any influence on the loading capacity of the lamp.

We claim:

1. An electrodeless low-pressure discharge lamp provided with a discharge vessel (10) which is closed in a gastight manner, which has a cavity (11), which encloses a discharge space, and which is provided with an ionizable filling, while a coil (20) with a winding (21) of an electric conductor and an assembly (30) of a heat conductor (31) with one or several elongate cores (32) of soft-magnetic material are accommodated in said cavity (11), which cores (32) are arranged along a longitudinal axis (33) of the assembly (30) in one or several recesses (34) of the heat conductor (31) which issue into a circumferential surface (36) of the assembly (30), characterized in that the heat conductor (31) occupies at least half the circumference of the assembly (30) in a cross-section (II—II) perpendicular to the longitudinal axis (33).

2. An electrodeless low-pressure discharge lamp as claimed in claim 1, characterized in that the heat conductor (31) accounts for at least one fourth of the total surface area of the assembly (30) of the heat conductor (31) and the one or several cores (32) of soft-magnetic material in said cross-section.

3. An electrodeless low-pressure discharge lamp as claimed in claim 1, characterized in that the assembly (130) comprises at least two cores (132*a* . . . *d*) of soft-magnetic material which are arranged in the heat conductor (131) around the longitudinal axis (133) of the assembly (130).

4. An electrodeless low-pressure discharge lamp as claimed in claim 3, characterized in that the heat conductor (231) has a recess (234*a*,234*b*) of a laterally clearing shape on either side of the longitudinal axis (233).

5. An electrodeless low-pressure discharge lamp as claimed in claim 1, characterized in that the cavity (11) of the discharge vessel is provided with an exhaust tube (12) which extends centrally within the assembly (30).

6. An electrodeless low-pressure discharge lamp as claimed in claim 1, characterized in that the cavity (11) is provided with a UV-reflecting layer.

7. An electrodeless low pressure discharge lamp comprising a discharge vessel comprising a cavity enclosing a discharge space enclosed in a gastight manner and provided with an ionizable filling, a heat conductor in said cavity, said heat conductor having a circumferential surface concentric to a longitudinal axis and at least one recess communicating with said circumferential surface via a plurality of openings in said surface parallel to said axis, a core of soft magnetic material arranged in each said recess, and a coil comprising a wound electric conductor arranged concentrically outside said circumferential surface.

8. An electrodeless low pressure discharge lamp as in claim 7 comprising a cylindrical core of soft magnetic material arranged in a cylindrical recess of said heat conductor concentric to said axis, said openings comprising a plurality of slits which interrupt said circumferential surface at a uniform spacing.

9. An electrodeless low pressure discharge lamp as in claim 7 comprising a plurality of cylindrical cores arranged symmetrically about said axis in a like plurality of respective said recesses.

10. An electrodeless low pressure discharge lamp as in claim 7 a pair of cores of substantially rectangular cross section are arranged in respective recesses which open directly on said circumferential surface on opposite sides of said axis.

11. An electrodeless low pressure discharge lamp as in claim 7 wherein said circumferential surface and said openings therein, seen in cross-section perpendicular to said axis, define a circumference, said circumferential surface occupying at least half said circumference.

* * * * *